US006525694B2

(12) United States Patent
Jiang et al.

(10) Patent No.: US 6,525,694 B2
(45) Date of Patent: Feb. 25, 2003

(54) HIGH GAIN PRINTED LOOP ANTENNA

(75) Inventors: Guozhong Jiang, Waterloo (CA); Xifan Chen, Kitchener (CA); Luke Zhu, Waterloo (CA)

(73) Assignee: Superpass Company Inc., Waterloo (CA)

( * ) Notice: Subject to any disclaimer, the term of this patent is extended or adjusted under 35 U.S.C. 154(b) by 0 days.

(21) Appl. No.: 09/912,062

(22) Filed: Jul. 25, 2001

(65) Prior Publication Data

US 2002/0027527 A1 Mar. 7, 2002

(30) Foreign Application Priority Data

Jul. 25, 2000 (CA) ..... 2314449

(51) Int. Cl.[7] ..... H01Q 11/12; H01Q 21/00
(52) U.S. Cl. ..... 343/742; 343/867; 343/700 MS
(58) Field of Search ..... 343/742, 741, 343/866, 867, 855, 700 MS; H01Q 11/12, 21/00

(56) References Cited

U.S. PATENT DOCUMENTS 3,631,499 A * 12/1971 Turner ..... 343/742
5,757,328 A * 5/1998 Saitoh ..... 343/713
6,067,052 A 5/2000 Rawles et al. ..... 343/741
6,252,561 B1 6/2001 Wu et al. ..... 343/866

OTHER PUBLICATIONS

Cai, M. and M. Ito, *New Type of Printed Polygonal Loop Antenna*, IEE proceedings –H. vol. 138, No. 5, Oct. 1991, pp. 389–396.

Johnson, R.C. and H. Jasik, *Antenna Engineering Hand Book*, McGraw Hill (2d, Ed. 1984), Chapter 5.

* cited by examiner

*Primary Examiner*—Hoanganh Le
(74) *Attorney, Agent, or Firm*—Kevin Pillay; Fasken Martineau DuMoulin LLP

(57) ABSTRACT

A high gain printed loop antenna comprises a first and second loop arranged symmetrically about a feed network, wherein each of the loops include pairs of substantially parallel radiation sections which when excited in phase from the feed network improves the gain of the antenna. Each of the parallel radiation sections are joined by patch elements such that the width of the patch elements is greater than the width of other portions of the loop. Thus, the patch elements allow for an increased variance in the path of a surface current through the loop.

11 Claims, 4 Drawing Sheets

TOP VIEW (a)

HIGH GAIN PRINTED LOOP ANTENNA

The present invention relates to the field printed loop antennas having high gain and wide band width.

BACKGROUND OF THE INVENTION

Printed circuit antennas are used in a variety communication systems and in particular in mobile communication systems because of their ease of manufacture, low cost, low weight, small volume and flush mount configurations.

Loop Antennas are relatively well known and often used for purposes of radio direction finding (RDF). Such antennas are described generally in "Antenna engineering hand book" Chapter 5, McGraw Hill (2d, Ed. 1984) by R. C. Johnson and H. Jasik Loop Antennas are most useful as elements of directional antennas when there perimeter is comparable to one wavelength. The loop antenna has further attractive characteristic in that the antenna is small enough compared with the operating wavelength.

On the other hand, printed loop antennas combine the advantages of printed circuit antennas and loop antennas. For example, back in the early 1990's, a reflector loop antenna was proposed by M. Cai and M. Ito in an article entitled "New type of printed polygonal loop antenna; IEE proceedings—H, vol. 138 no. 5, October 1991, pp. 389–396". Further loop antenna configurations for printed wire board applications are described in U.S. Pat. No. 6,067,052.

Given the rapid development of wireless communication systems, there is a need for a printed loop antenna having extremely high gain and which is particularly useful in applications requiring embedded antennas. A drawback of conventional loop antennas in these applications is that they are commonly fed from one of there sides; therefore; a symmetry in the radiation pattern is caused by the feed network resulting in a squinted radiation pattern.

There is thus a need for a printed loop antenna which mitigates at least some of the above disadvantages of conventional loop antennas.

SUMMARY OF THE INVENTION

In accordance with this invention there is provided a printed loop antenna comprising:

a) a first and second rectangular loop arrange symmetrically on either side of centre feed line; and b) a feed network is coupled to feed both loops, thereby defining a single element antenna.

In accordance with another aspect of the invention, each of the loops comprise parallel portions defining four dipoles polls and which when properly spaced and excited in phase, generate a high gain.

The antenna of the present invention also exhibits more than 20% bandwidth as portions of the loop provide multiple paths for the surface current of the antenna.

In accordance with a further aspect of the inventions a metal reflector is arranged in one plane of the antenna to provide a directional radiation pattern.

In a still further aspect of the invention a plurality of the individual antennas may be combined to form a two element and eight element array.

BRIEF DESCRIPTION OF THE DRAWINGS

A better understanding of the invention will be obtained by reference to the detailed description below in conjunction with the following drawings in which:

FIGS. 2A and 1B are respective top and side views of a further embodiment of a printed loop antenna according to the present invention;

DETAILED DESCRIPTION OF THE PREFERRED EMBODIMENT

Figure 1:
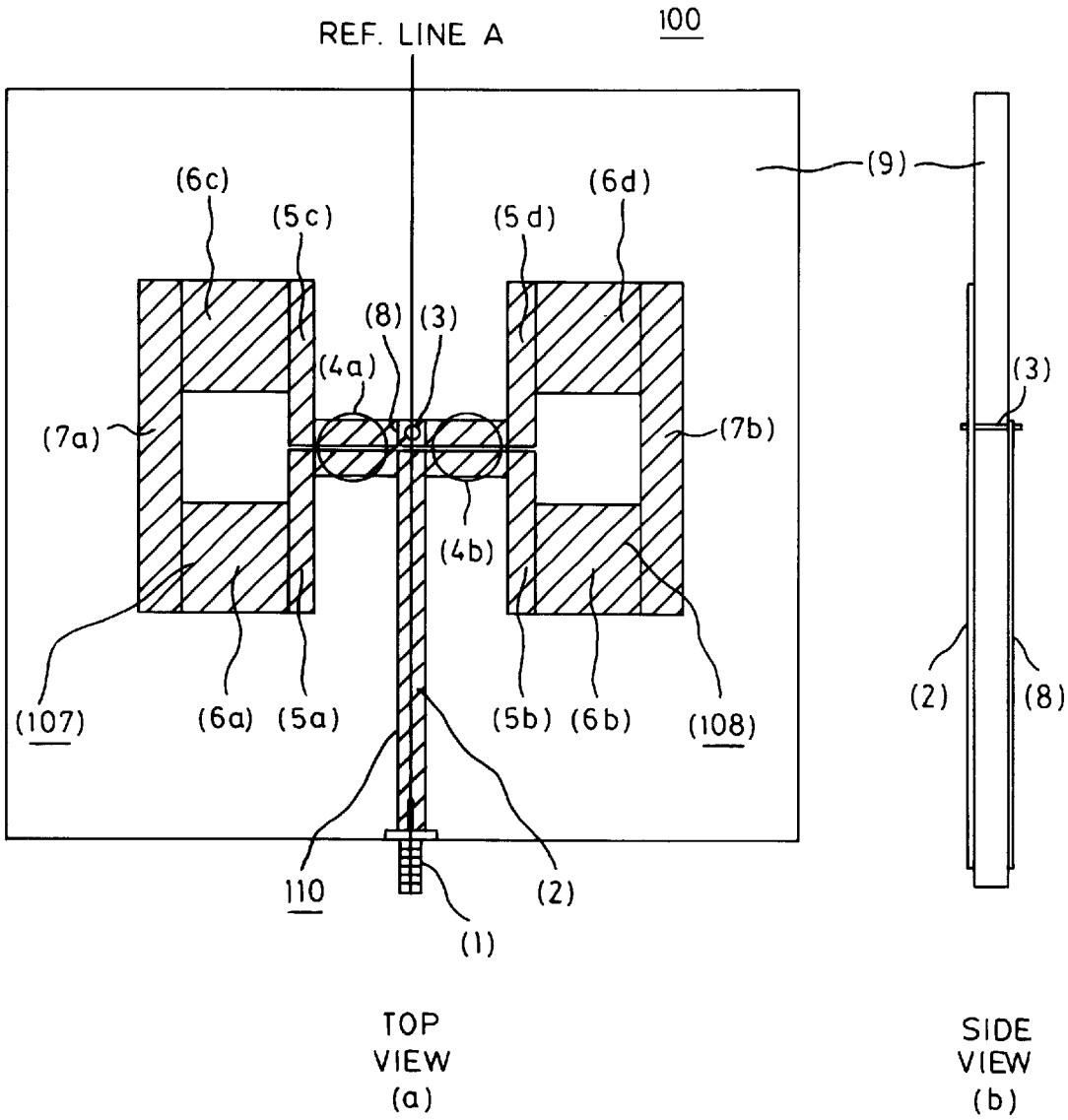
FIGS. 1A and 1B are respective top and side views of a printed loop antenna according to an embodiment of the present invention.

In the following description, like numerals refer to like structures in the drawings. Furthermore for either explanation regarding the functions of each part of the antenna, a "dash-dot-dot" line is used to divide the antenna configuration into sevens segments.

Referring now to FIGS. 1A and 1B, a loop antenna in accordance with an embodiment of the present invention is shown generally by numeral 100. The antenna comprises conductive segments (indicated by the hatched sections) of thin copper sheets bonded to respective surfaces of a dielectric material mine. The conductive segments includes the rectangular loops 107 and 108 arranged symmetrically on either side of a reference line A. The antenna is symmetric with rest to the reference line A and each of the conductive segments can be fabricated by etching or milling The dielectric material such as a 60-ml FR4 printed circuit board (PCB) with a dielectric constant of approximately 4.2. Since the FR4 PCB is a fairly low cost material, the antenna thus can be built more cost effectively without sacrificing the antenna gain due to the loss of the FR4 material. The antenna includes a feed network 110 comprising a transmission line formed of conductive segments 2 and 8 arranged on the respective surfaces of the PCB. The aligned segments 2 and 8 are connected by a via 3 as indicated in FIGS. 1A and 1B. A pair of single sided transmission lines 4A and 4B extend from lines 2 and 8 to the rectangular loop structures 107 and 108 respectively. A 50 Ohm connector located at the edge of the PCB is coupled to fee the double sided transmission lines 2 and 8. As may be seen in the drawing, the transmission line segment 8 is coupled by the via 3 to one of each of the pairs of single sided transmission lines 4A and 4B, while the transmission line segment 2 is coupled to the other of each of the pairs of the single sided transmission lines 4A and 4B.

In the configuration of this antenna according to this invention, a closed loop is formed, so the antenna is DC grounded. In addition, it is known that for a conventional loop antenna, the input impedance at the feed point is about 100–200 Ohm However, the width of transmission lines (4*a*)(4*b*) are optimized to match the antenna (Their width is about 3 mm at 2.44 GHz.), the input impedance of the antenna is close to 50 Ohm, therefore it is extremely easy for the loop antenna to be connected to 50 Ohm terminal.

The radiation parts of the loop antenna are constituted by the two symmetric rectangular loops 107 and 108. As seen in the diagram the vertical strips, (5*a*)(5*c*) and (5*b*)(5*d*), can be considered as dipoles respectively. And vertical strips (7*a*), (7*b*) function as dipoles as well. The length of each strip is 38 mm (or 0.55 wavelength) at 2.44 GHz, it is close to the theoretical length of a general panted dipole. The spacing between "dipoles" is defined by their centre to centre spacing. To achieve higher antenna gain, the optimal spacing is that which is found to provide proper in-phase signal to each "dipole". In one embodiment, the spacing between segments (7*a*) and (5*a*)(5*c*) is 16 mm (0.23 wavelength), the spacing between (5*a*)(5*c*) and (5*b*)(5*d*) is 24 mm (0.35 wavelength), and the spacing between (5*b*)(5*d*) and (7) is 16 mm (0.23 wavelength), when the operating frequency range is 2.40~2.483 GHz.

Other than rectangular loops, square, circular, and elliptical loops have been implemented, it was found that the antenna with rectangular loops offers the best performances, even though the antenna with the other kinds of loops are still provide adequate performances.

The antenna according to this invention also has more than 20% bandwidth, which is wider than that of conventional loop antennas. The main reason is that four horizontal patches (6*a*) (6*b*) (6*c*) (6*d*) are specially designed, every patch is quite wide and it is 0.18 wavelength wide. Therefore the path of the surface current of the loop antenna can vary in a relatively large range. As we know, the length of the surface current path is inversely proportional to the operating frequency of the antenna Since the length can vary in a quite wide range, wide bandwidth is achieved.

Figure 2:
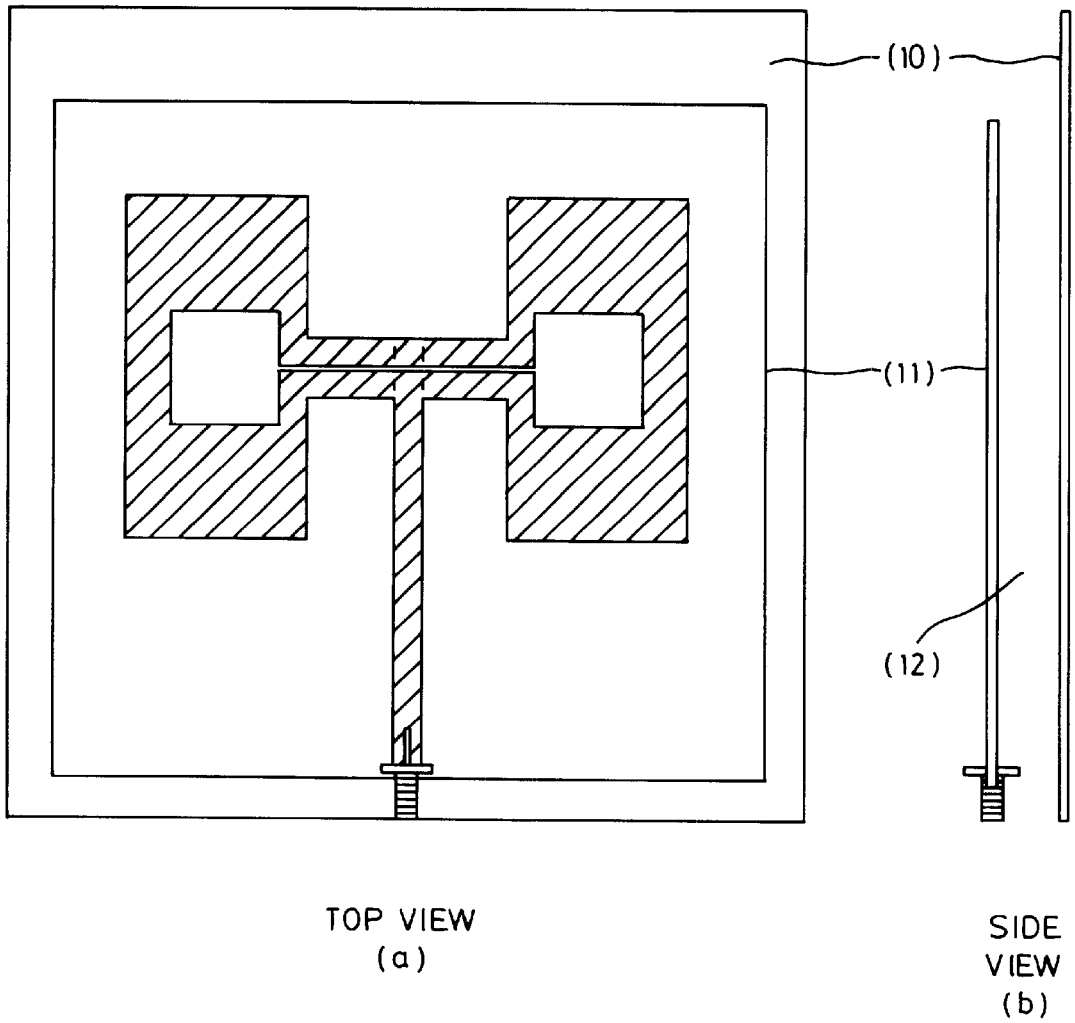

The antenna illustrated in FIG. 1 has a bi-directional radiation pattern. However, for most applications, directional antennas are preferred, therefore as shown in FIGS. 2(*a*) and 2(b), a metal reflector (10) is placed on one side of the antenna. Dielectric material (12), such as air, foam, and etc, can be used to fill the spacing between the reflector and PCB (11). In this case, air is used, mainly because air contributes no loss and no cost, as long as the distance between the PCB and the reflector is reasonable. The distance between the reflector and the PCB is quite critical for the gain of the antenna Experiments show that when the spacing is 14~20 mm (0.11~0.16 wavelength in the air), the highest gain can be achieved and the variation of gain is less than 0.2 dB within the range. It is known that for conventional loop antennas, spacing between the loop and the metal reflector is usually quarter wavelength, which is about 30 mm. So, compared with conventional loop antennas, the antenna according to this invention offers a lower profile, and it provides a very attractive antenna characteristics.

Operating within 2.40~2.83 GHz, based on FR4 PCB, the antenna according to this invention with a metal reflector has about 9.3 dBi gain. Also it has 3 dB beam width of 60, and more than 20% bandwidth, while its total size is only 120×110×30 (mm×mm×mm), If PR4 PCB is replaced by low loss RF-35 PCB, even higher gain of 10 dBi is achieved. Certainly, the design can be scaled up to higher frequencies or scaled down to lower frequencies, while the characteristics of the antenna will remain almost the same. In addition, experiments show that when some comers of the rectangular loops are trimmed off or smoothened, the properties of the antenna remain unchanged.

Figure 3:
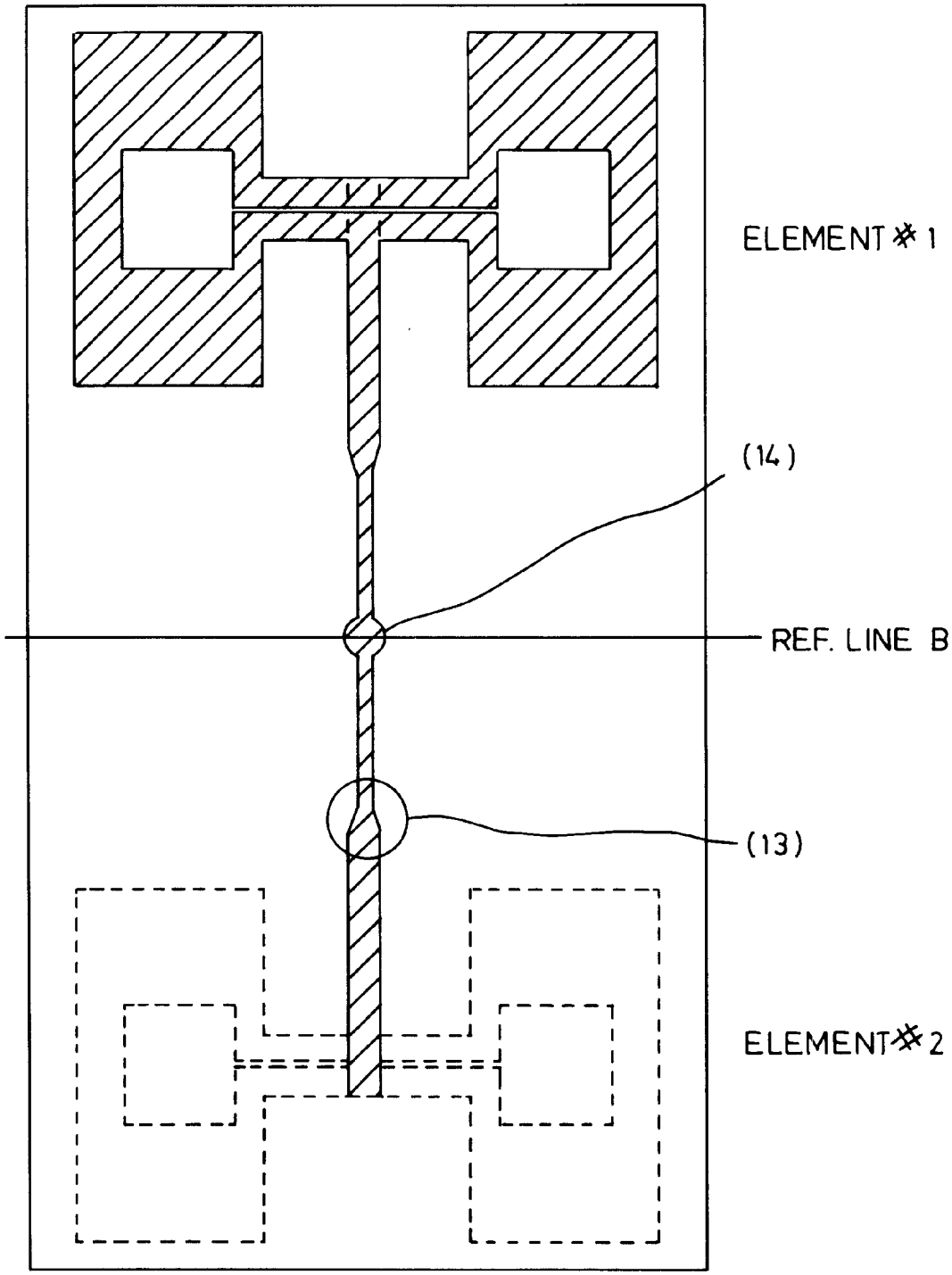
FIG. 3 is a top view of a centre fed two element printed loop antenna army according to a Her embodiment of the invention.

A two-element loop antenna array according to the invention is shown in FIG. 3, where element #1 is on the front side of PCB, and element #2 is on the backside PCB. A simple feed network (13) is designed to connect the elements. The configuration of the array is symmetric and it can be fed from its geometric centre (14).

Figure 4:
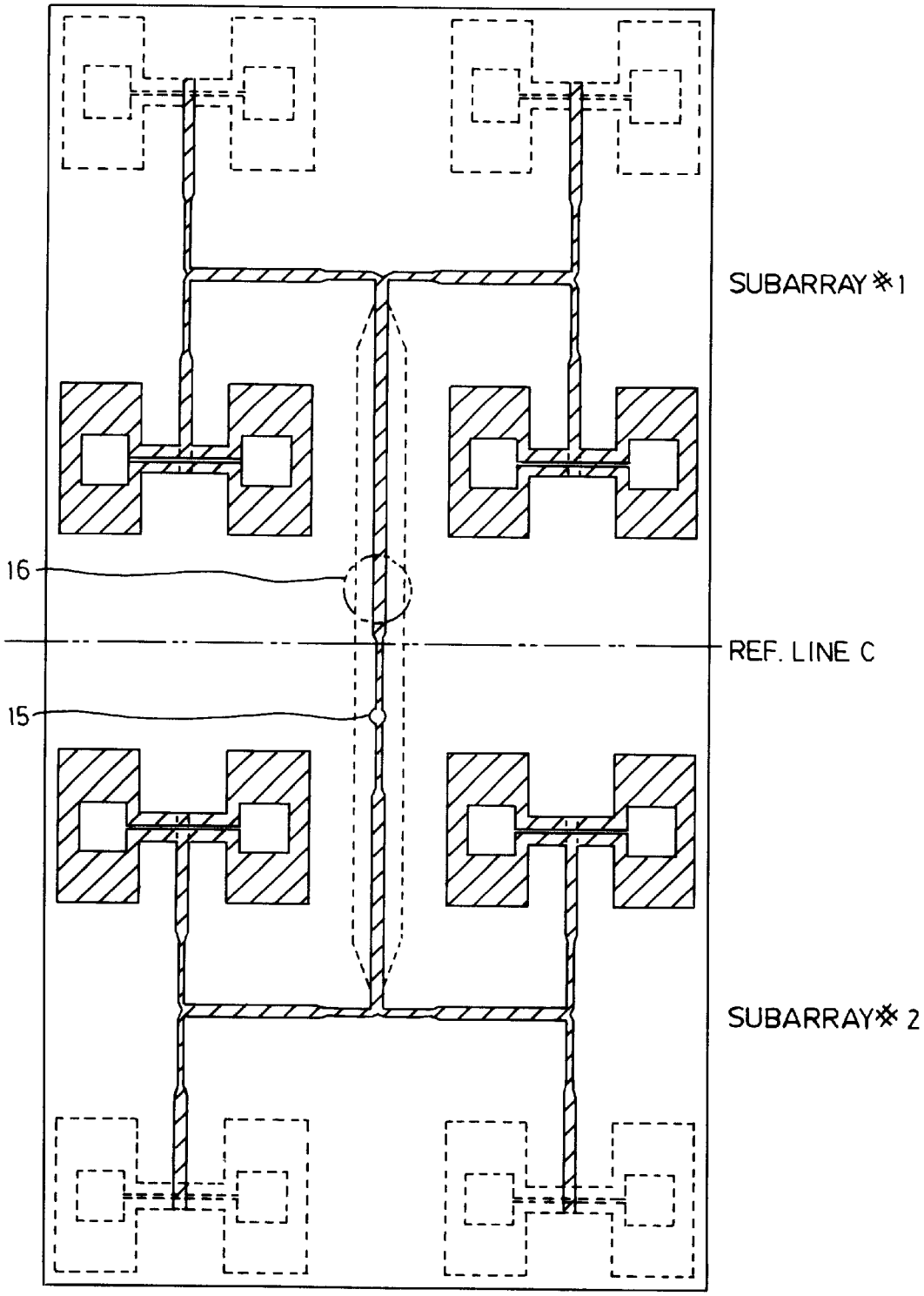
FIG. 4 is a top view of an eight element printed loop antenna loop array in accordance with a still further embodiment of the invention.

Based on two-element loop antenna array, an eight-element loop antenna array is shown in FIG. 4 and which is fed from a point (15). The sub-array #1 is symmetric to sub-array #2 along a reference line C. Compared with other arrangements, the array has about 0.4 dBi more gain. Moreover, microstrip line (16) is used at the central part of the array, because microstrip line causes less loss compared with double-sided transmission line.

While the invention has been described in connection with a specific embodiment thereof and in a specific use, various modifications thereof will occur to those skilled in the art without departing from the spirit of the invention.

The terms and expressions which have been employed in the specification are used as terms of description and not of limitations, there is no intention in the use of such terms and expressions to exclude any equivalents of the features shown and described or portions thereof, but it is recognized that various modifications are possible within the scope of the invention.

We claim:

1. A high gain printed loop antenna comprising:

first and second loops arranged symmetrically about a feed network, wherein each of the loops include pairs of substantially parallel radiation sections which when excited in phase from the feed network improves the gain of the antenna, each of the parallel radiation sections being coupled by patch elements such that the width of the patch elements is greater than the width of other portions of the loop, wherein the width of the patch elements allows increased variance in the path of a surface current through the loop.

2. The antenna as defined in claim 1, said loops being rectangular.

3. The antenna as defined in claim 1, said loops being either one of quasi-rectangular, square, circular, and elliptical.

4. The antenna as defined in claim 1 said parallel sections each being about 0.55 wavelengths.

5. The antenna as defined in claim 1, said parallel sections in each said loop being joined by patch elements each being about 0.18 wavelengths wide.

6. The antenna as defined in claim 1, said feed network including a double sided section and a single sided section, said double sided section for coupling to a connector and said single sided section for coupling said double sided section to said first and second loops wherein said feed network both drives and matches said antenna.

7. The antenna as defined in claim 6 including a via for coupling said double sided section to said single sided section.

8. The antenna as defined in claim 1, including a conductive reflector on one side of said antenna for producing a directional radiation pattern.

9. An antenna array comprising:

two or more high gain printed loop antennas each comprising first and second loops arranged symmetrically about a feed network, wherein each of the loops include pairs of substantially parallel radiation sections which can be excited in phase from the feed network to thereby improve the gain of the antenna, each of the parallel radiation sections being joined by patch elements such that the width of the patch elements is greater than the width of other portions of the loop, wherein the width of the patch elements allows increased variance in the path of a surface current through the loop; and a feed network for coupling each of the loop antennas.

10. A high gain printed loop antenna comprising:

first and second loops arranged symmetrically about a feed network, wherein each of the loops include pairs of substantially parallel radiation sections which when excited in phase from the feed network improves the gain of the antenna, said feed network including a double sided section and a single sided section, said double sided section for coupling to a connector and said single sided section for coupling said double sided section to said first and second loops wherein said feed network both drives and matches said antenna.

11. The antenna as defined in claim 10 including a via for coupling said double sided section to said single sided section.

* * * * *